United States Patent [19]

Varga et al.

[11] Patent Number: 4,514,911

[45] Date of Patent: May 7, 1985

[54] METHOD FOR REMOVING MOISTURE ADHERED TO SURFACES OF BODIES AND FOR SIMULTANEOUSLY ADJUSTING THE SURFACE TEMPERATURE OF THE BODIES

[75] Inventors: László Varga; Sándor Krekács; János Latorcai; Zoltán Pálfi, all of Budapest; István Fledrich, Gödöllö, all of Hungary

[73] Assignee: Budapesti Muszaki Egyetem, Budapest, Hungary

[21] Appl. No.: 397,876

[22] Filed: Jul. 13, 1982

[51] Int. Cl.[3] ..... F26B 3/04

[52] U.S. Cl. ..... 34/22; 34/54

[58] Field of Search ..... 34/104, 105, 54, 73, 34/79, 77, 22, 30, 44

[56] References Cited

U.S. PATENT DOCUMENTS 3,791,046 2/1974 Bruggink ..... 34/104

4,145,818 3/1979 Kulling ..... 34/32

*Primary Examiner*—Larry I. Schwartz

*Attorney, Agent, or Firm*—Young & Thompson

[57] ABSTRACT

A method for removing the moisture adhered to surfaces of bodies and simultaneously for adjusting the surface temperature of the bodies to a predetermined value, in which air or steam having a temperature within the range of ±10 degrees centigrade of the surface temperature to be reached is streamed along the surface of the body, wherein an average velocity of stream of the air or steam is as follows:

$$\bar{v}_1 = c\sqrt{\frac{g \cdot t_v}{G_1} \cdot v_{v1} \cdot (R_b - R_1)^{-1}} \cdot \frac{1}{1 - f_1}$$

wherein $\bar{v}_1$ is the average velocity of stream of the air or steam, g is the gravitational acceleration ($g = 9.81$ m/s$^2$), $t_v$ is the dynamic viscosity of the moisture in the state of its removal, $G_1$ is the specific weight of the air or steam in the state or removal of the moisture, $v_{v1}$ is the velocity of stream of the moisture at radius $R_1$, $R_b$ is the hydraulic radius of the moistened surface, $R_1$ is the hydraulic radius of the interface of the moisture and the air or steam, $f_1$ is the degree of saturation of the air or steam, c is $$c = \sqrt{\frac{8}{k}},$$

wherein $0.0015 < k < 3$ and k is the modified resistance coefficient.

1 Claim, 19 Drawing Figures

METHOD FOR REMOVING MOISTURE ADHERED TO SURFACES OF BODIES AND FOR SIMULTANEOUSLY ADJUSTING THE SURFACE TEMPERATURE OF THE BODIES

The invention relates to a method for removing the moisture, i.e. the adhered to the surfaces of bodies and simultaneously for adjusting the surface temperature of the bodies to a previously determined surface temperature. This adjusting of temperature is also called tempering.

As is well known, a technological process often includes cleaning and drying, i.e. a humidity removing operation and, thereafter, also a temperature adjusting operation. In the production of electric discharge lamps such as neon tubings, for example, a washing and drying procedure is followed by a deposition by evaporation in vacuum. For the latter, a pre-determined temperature of the tubing is required.

In all cases similar to this, the drying and the tempering of the surface are achieved in two separate working operations. The humidity adhered to the surfaces of the bodies is removed by diffusion drying and the surface temperature is adjusted to the previously given value by a caloric process.

The efficiency of the diffusion drying is determined, among others, by the temperature of the drying medium. Therefore, a relatively warm drying agent is used which reduces the time of the operation as well as the size of the dryer equipment. As a result of this, the surface temperature of the dried body will be increased after drying. For reaching the technologically optimal surface temperature, the dried body surface must subsequently be cooled down.

As is obvious, a great amount of energy is consumed for drying (and, consequently, warming up) and, subsequently, for tempering (i.e. cooling down) the body to be treated. The high temperature for efficient drying and the low temperature for the efficient tempering are, thus, in contrast. To avoid this disadvantage, an optimum was sought for the level of these temperatures which is in most cases impossible to determine, only a compromise can be reached. The above contradiction can not be resolved.

Accordingly, it is an object of this invention to provide a method wherein the subsequent operations of drying and adjusting the surface temperature are not in contradiction, i.e. wherein the first operation is not adverse to the second.

The basic idea of the invention is that, instead of diffusion drying, a drying procedure with air or steam flow should be used.

The knowledge of this idea resulted in a further object to be achieved by this invention. Further to what have been said hereinabove, a method should be provided wherein the drying and temperature adjusting procedure will be fulfilled in one and the same operation.

As is well known, the drop in pressure of a medium streaming along another medium results in forces perpendicular to the direction of flow. As an effect of these the streaming medium tends to educt this second medium. If this second medium is the humidity adhered to the body surface to be dried and the streaming medium is air or steam, the humidity can be removed from the surface without the need of other drying procedure such as diffusion drying. In other words, removing the humidity is possible not only by a caloric process, i.e. by increasing the surface temperature of the body but also by the appropriate drop in pressure of the streaming medium.

Furthermore, if the temperature of the streaming medium is within a narrow range of the predetermined surface temperature of the tempering, the drying and the temperature adjusting can be fulfilled simultaneously, in the same working operation.

We have carried out an extensive search and experimental activity for determining the flow pattern and, for this, the flow velocity of the streaming medium.

It has been found that the above objects will simply be achieved if air or steam is streamed along the surfaces of the body to be treated, if the temperature is within a range of ±10 degrees centigrade of the surface temperature to be achieved and, furthermore, if the average velocity of the streaming air or steam has a value as follows:

$$\bar{v}_l = c\sqrt{\frac{g \cdot t_v}{G_l} \cdot v_{vl} \cdot (R_b - R_l)^{-1}} \cdot \frac{1}{1 - f_l},$$

wherein, $\bar{v}_l$ is the average velocity of the stream of the air or steam, g is the gravitational acceleration ($g = 9{,}81\ m/s^2$), $t_v$ is the dynamic viscosity of the humidity in the state of its removal, $G_l$ is the specific weight of the air or steam in the state of removal of the humidity, $v_{vl}$ is the velocity of the stream of the humidity at radius $R_l$, $R_b$ is the hydraulic radius of the humidified surface, $R_l$ is the hydraulic radius of the interface of the humidity and the air or steam, $f_l$ is the degree of saturation of the air or steam (or relative humidity, having a maximum value of 1), c is a constant calculated as follows:

$$c = \sqrt{\frac{8}{k}},$$

wherein $0.0015 < k < 3$ is the modified resistance coefficient.

As apparatus for practicing the method of the invention, a nozzle or a plurality of nozzles are provided for conducting air or steam along the surface of the body to be treated, the air or steam having a temperature within the range of ±10 degrees centigrade of the surface temperature to be achieved.

Further objects, features and advantages of this invention will be described hereinunder in greater detail in connection with exemplified embodiments and with reference to the attached drawings. In the drawings, FIGS. 1 to 19 show respectively nineteen different connection diagrams of various exemplified embodiments.

As is clearly apparent from what has been said hereinabove, at least two conditions must be satisfied for achieving the object of the invention: the temperature of the streaming air or steam must be within a temperature range of ±10 degrees centigrade of the surface temperature to be reached and, on the other hand, the average velocity of stream $\bar{v}_l$ must have a value calculated according to the above equation. For this, a nozzle or a plurality of nozzles are inevitably needed. But, in most cases, the pressure and temperature of the air or steam available are not convenient for the purposes of the invention. For changing these values, a heat exchanger and a medium transporter are needed.

BRIEF DESCRIPTION OF THE DRAWINGS

In FIG. 1, a medium transporter is shown by 1, a heat exchanger at 2, a nozzle at 3 and a body to be treated or workpiece at 4. These elements are connected in series in the above sequence. The workpiece 4 is here a hollow one, e.g. a tube from the inside of which the humidity should be removed. With medium transporter 1 and with nozzle 3, the average velocity $\bar{v}_l$ and the flow pattern in the inside of the tube are generated. With heat exchanger 2, the prescribed temperature is achieved. Nozzle 3 blows the air or steam with the necessary speed and temperature into the tubular workpiece 4. Passing through workpiece 4, the air or steam suffers a given drop in pressure, for the purpose of which the average velocity $\bar{v}_l$ is calculated. As stated above, this drop in pressure of the streaming medium has a result of removing the humidity adhered to the surface. Thus, the humidity adhered to the inner surface of the tubular workpiece 4 is "blown out" by the air or steam. In the course of this removal of humidity, the surface temperature determined previously according to the needs of the further technological process is also reached. Thus, in one and the same working operation, the humidity is removed and the surface temperature is adjusted as well. A medium path of the air or steam leaving the workpiece 4 is shown at 6 and a liquid path also leaving the workpiece 4 at 5 with a dashed line.

In FIG. 2, the nozzle 3 and the workpiece 4 are shown in cross section. In this example, the heat exchanger 2 is connected before the medium transporter 1 and a drip separator 12 is connected into the liquid path 5 and medium path 6 leaving the tubular workpiece 4 for separating the liquid content of the streaming air or steam. As a result of this, the air used in the process can be redirected and used again.

Figure 3:
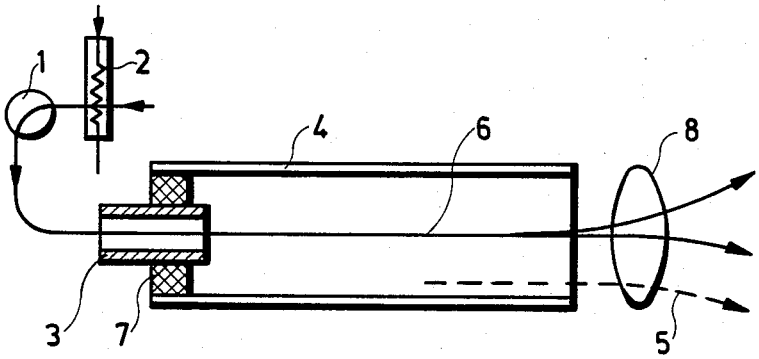

In the example of FIG. 3, the nozzle 3 is built into a seal or gasket 7 which interconnects the inner surface of workpiece 4 and nozzle 3. With this, a back-flow of the streaming medium is prevented and a better flow pattern within the workpiece 4 is provided. In addition, a suction nozzle 8 is arranged behind the workpiece 4, with the aid of which the optimal flow pattern can be maintained even with long workpieces 4, also in the final part of them.

Figure 1:
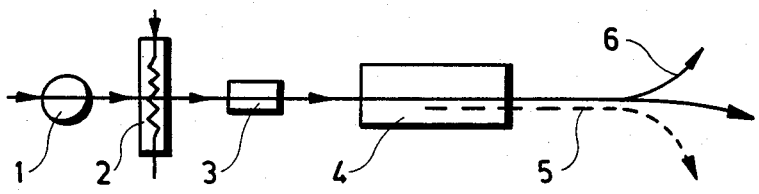
FIG. 1 is a schematic representation of the present invention.
Figure 2:
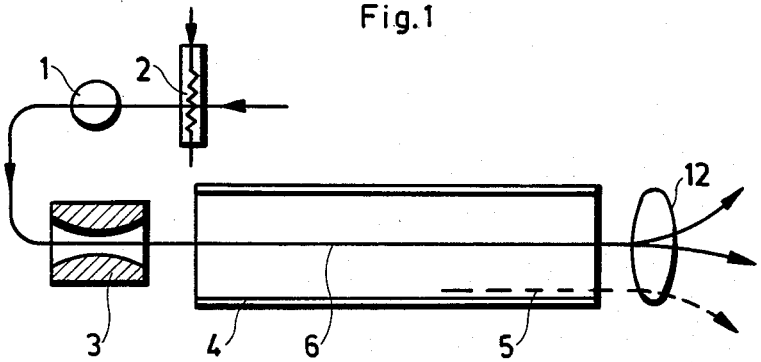
FIGS. 2–19 show alternative embodiments of the present invention.
Figure 4:
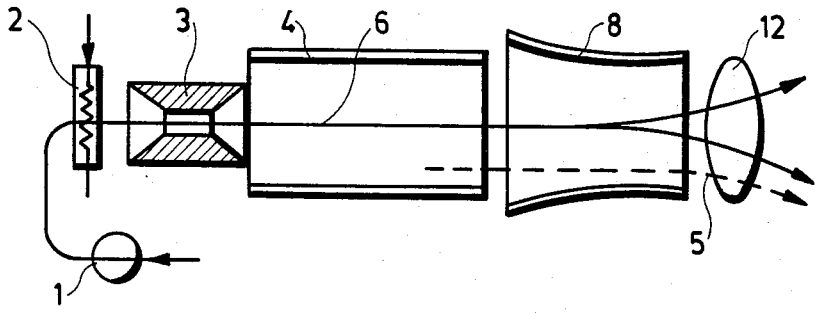

In FIG. 4, not only nozzle 3 and workpiece 4 but also suction nozzle 8 are shown in cross section. In this example, a drip separator 12 as in FIG. 2 is also connected behind suction nozzle 8.

Figure 5:
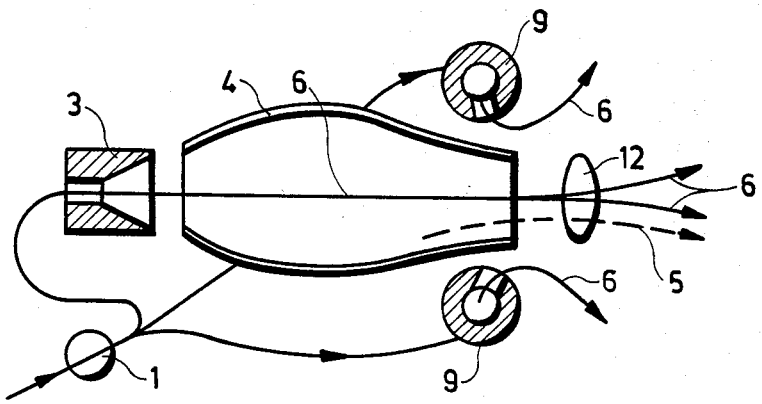

In FIG. 5, a hollow workpiece 4 is shown having a shape in cross section other than tubular. Assuming that the air or steam used here has a temperature within the range of ±10 degrees centigrade of the surface temperature of the workpiece 4 to be reached, no heat exchanger is required in the circuit. However, it has been found that the humidity removed from the inner surface of the workpiece 4 tends to drop down or flow back on the outer surface at the end opening of the workpiece 4. For preventing this, auxiliary nozzles 9 are provided around the end opening of workpiece 4, the medium pathes 6 taking with them the humidity flowing out here. Nozzle 3 and auxiliary nozzles 9 are connected in parallel to medium transporter 1.

Figure 6:
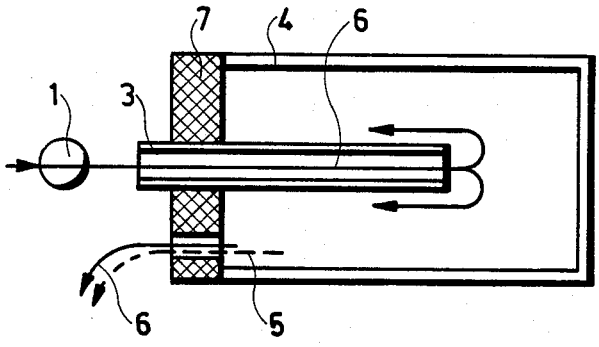

With the cup-shaped workpiece 4 in FIG. 6, a long nozzle 3 is used directing the air or steam from medium transporter 1 into the inside of the cup. The opening of the cup-shaped workpiece 4 is closed by a gasket 7 through an opening of which the air and the humidity removed from the inner surface of the cup are removed.

Figure 7:
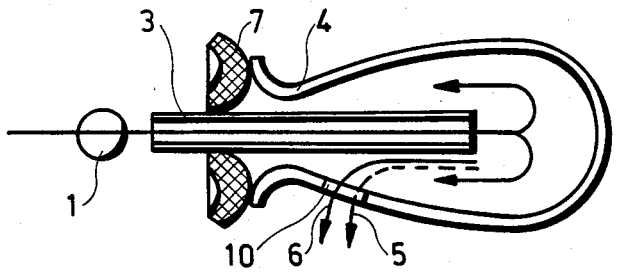

The same kind of nozzle 3 with another gasket 7 and with a bulb-shaped workpiece 4 is shown in FIG. 7. Medium path 6 and liquid path 5 leave through an outlet orifice 10 provided in the workpiece 4 itself.

Figure 8:
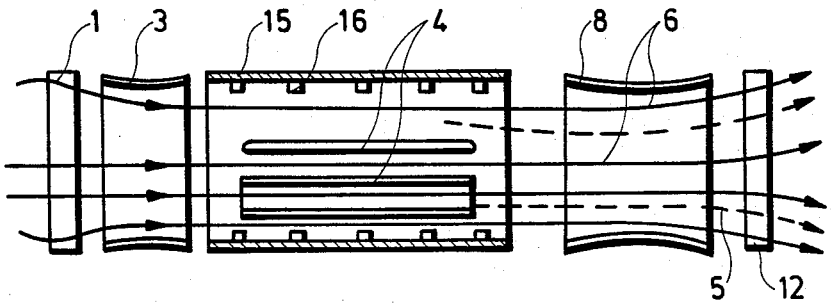

In the example of FIG. 8, a system for treating the inner surface and, at the same time, the outer surface of a workpiece 4 is shown. A rod-like workpiece and a tubular one are arranged in a hollow guiding piece 15 in which the desired flow velocity and pattern are produced by medium transporter 1 such as a blowing fan, by nozzle 3, by pieces 16 increasing the resistance to flow of the medium and which are fixed to the inner surface of hollow guiding piece 15 and by suction nozzle 8. The streaming air or steam enters the hollow guiding piece 15, flows through it and subsequently through suction nozzle 8 as well as drip separator 12. In the course of this, the humidity adhered to the inner and outer surfaces of the workpieces 4 is removed, and the liquid is separated from the air in drip separator 12.

Figure 9:
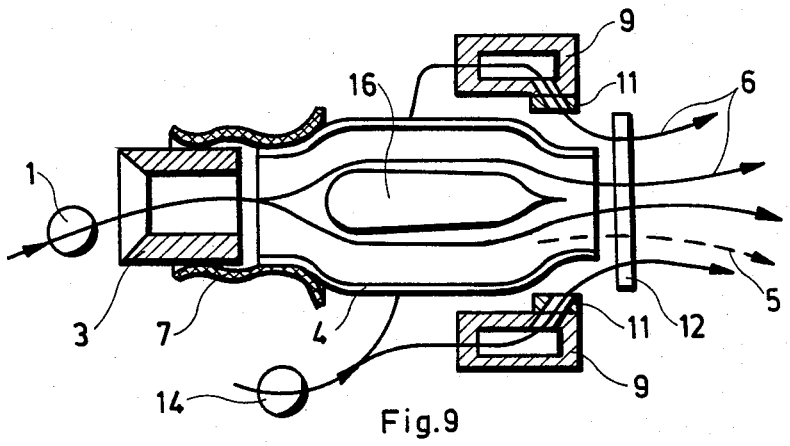

In FIG. 9, a workpiece 4 is illustrated, whose dimension perpendicular to the direction of flow of air or steam is much greater than that in the direction of flow. For the desired flow pattern, piece 16 increasing the resistance of flow is arranged in the inside of workpiece 4. In this case, piece 16 performs a kind of choking or throttling causing the necessary drop in pressure of streaming air or steam along workpiece 4. Auxiliary nozzles 9 are also provided, the purpose and function thereof being the same as in FIG. 5. However, the auxiliary nozzles 9 are connected here to a separate blast transporter 14 feeding them with air or steam. Furthermore, they have an interchangeable nosepiece 11 with the help of which the flow pattern of auxiliary nozzles 9 can be adjusted to the speical demands of various workpieces 4. The liquid path 5 and medium path 6 of the system are led through drop separator 12.

Figure 10:
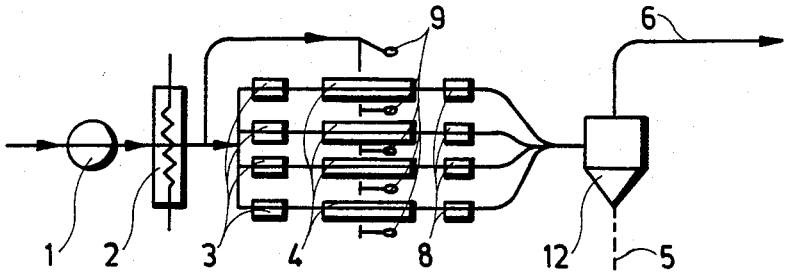

In the example of FIG. 10, a plurality of nozzles 3, workpieces 4, auxiliary nozzles 9 and suction nozzles 8 is fed with streaming air or steam by medium transporter 1 through heat exchanger 2. On the outlet side, the suction nozzles 8 are connected to a common drip separator 12 wherein the liquid path 5 is separated from the medium path 6.

Figure 11:
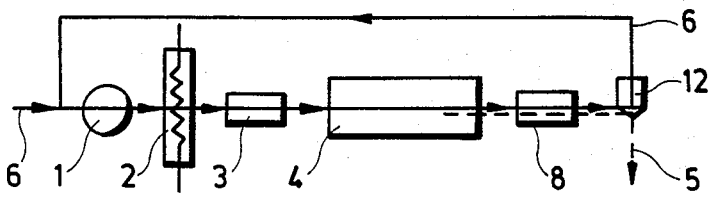
Figure 12:
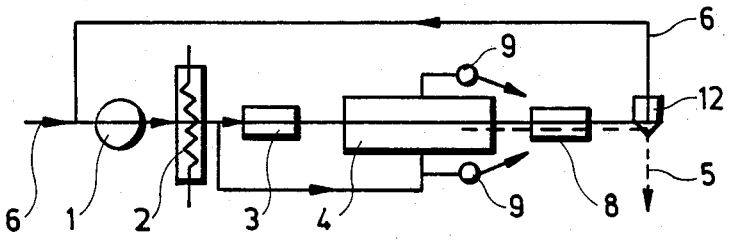

FIGS. 11 and 12 show the system in this invention with provision for redirecting the medium path 6 and repeatedly using the air. The liquid removed from the surfaces of the workpiece 4 leaves through drip separator 12 along liquid path 5. In FIG. 12, auxiliary nozzles 9 are also provided.

Figure 13:
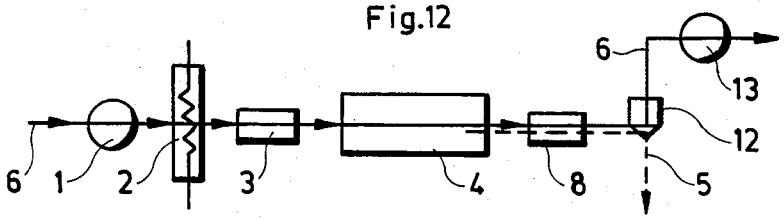
Figure 14:
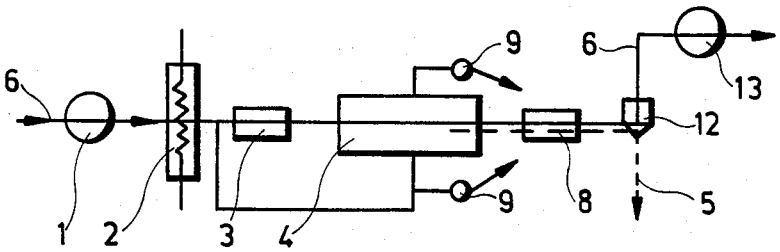

In FIG. 13, a system as in FIG. 11 and in FIG. 14 one as in FIG. 12 are shown, however, without the redirection of medium path 6. Here, a suction transporter 13 is provided with which the air leaving the drip separator 12 is discharged from the system, e.g. into the ambient.

Figure 15:
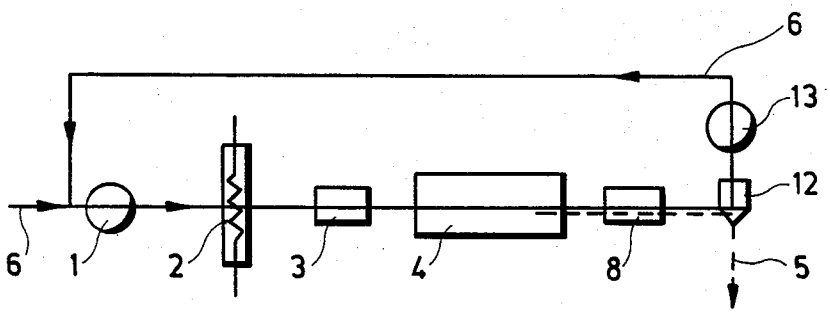

As is obvious from FIG. 15, suction transporter 13 can be used with a system shown in FIG. 11 for redirecting medium path 6 to medium transporter 1.

Figure 16:
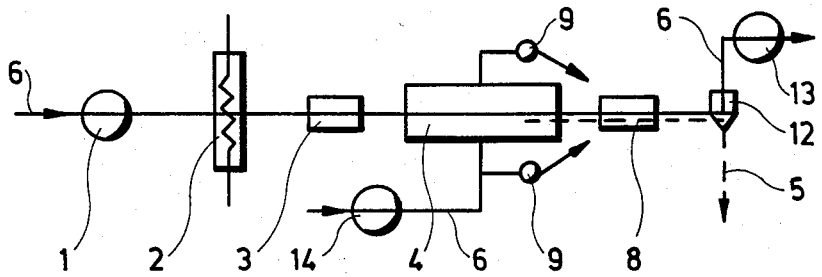
Figure 17:
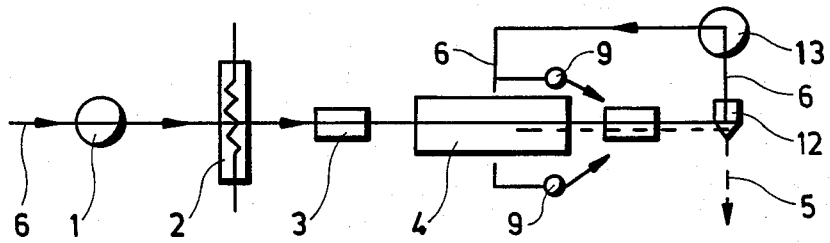

Furthermore, the auxiliary nozzles of FIG. 14 can be fed by a separate blast transporter 14 as shown in FIG. 16. On the other hand, they can be connected to the medium path 6 outlet of drip separator 12 with the interconnection of suction transporter 13 as in FIG. 17. The auxiliary nozzles 9 are fed here with the recycled air pressurized as necessary by suction transporter 13.

Figure 18:
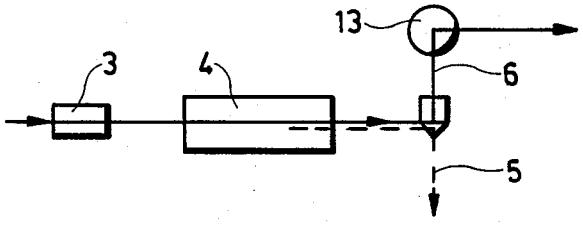

If the air or steam used in this invention has the desired temperature and if the nozzle 3 and the shape of workpiece 4 make it possible, suction transporter 13 alone is enough for providing the desired velocity and pattern of steam in the system, as it is shown in FIG. 18.

Figure 19:
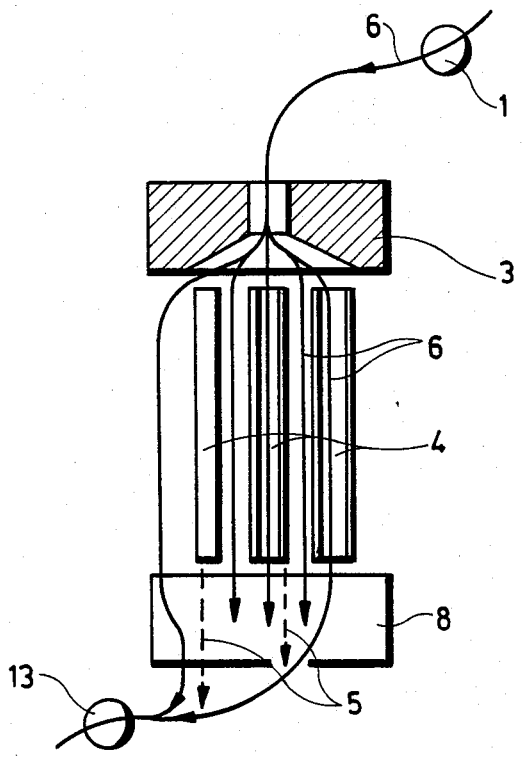

As illustrated in FIG. 19, more than one workpiece 4 can be treated with one nozzle 3 and one suction nozzle 8 both having an appropriate design.

The examples described hereinabove are only some of the variation possibilities within the scope of this invention.

We claim:

1. Method for removing moisture adhered to surfaces of bodies and simultaneously for adjusting the surface temperature of the bodies to a predetermined value, comprising providing air or steam having a temperature within a range of ±10 degrees centigrade of said predetermined temperature, and streaming said air or stream along the surface of the body with a velocity $$\bar{v}_1 = c\sqrt{\frac{g \cdot t_v}{G_1} \cdot v_{v1} \cdot (R_b - R_1)^{-1}} \cdot \frac{1}{1 - f_1},$$

wherein $\bar{v}_l$ is the average velocity of stream of the air or steam, g is the gravitational acceleration ($g = 9.81\ m/s^2$), $t_v$ is the dynamic viscosity of the moisture in the state of its removal, $G_l$ is the specific weight of the air or steam in the state of removal of the moisture, $v_{vl}$ is the velocity of stream of the moisture at radius $R_l$, $R_b$ is the hydraulic radius of the moistured surface, $R_l$ is the hydraulic radius of the interface of the moisture and the air or steam, $f_l$ is the degree of saturation of the air or steam, c is $$c = \sqrt{\frac{8}{k}},$$

wherein $0.0015 < K < 3$ and k is the modified resistance coefficient.

* * * * *